US012663178B2

(12) United States Patent
Zhang et al.

(10) Patent No.: US 12,663,178 B2
(45) Date of Patent: Jun. 23, 2026

(54) AIR TREATMENT APPARATUS AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Zijian Zhang, Foshan (CN); Yi Ding, Foshan (CN); Zhonghua He, Foshan (CN); Ganggang Yang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 386 days.

(21) Appl. No.: 18/230,963

(22) Filed: Aug. 7, 2023

(65) Prior Publication Data

US 2023/0375217 A1 Nov. 23, 2023

Related U.S. Application Data

(63) Continuation of application No. PCT/CN2021/091662, filed on Apr. 30, 2021.

(30) Foreign Application Priority Data

Feb. 8, 2021 (CN) ..... 202110172461.7
Feb. 8, 2021 (CN) ..... 202120373153.6

(51) Int. Cl.
*F24F 1/0073* (2019.01)
*F24F 8/80* (2021.01)
(Continued)

(52) U.S. Cl.
CPC ..... *F24F 13/20* (2013.01); *F24F 1/0073* (2019.02); *F24F 1/0087* (2019.02); *F24F 2221/32* (2013.01)

(58) Field of Classification Search
CPC ..... F24F 13/20; F24F 13/28; F24F 1/0073; F24F 1/0087; F24F 2221/32; F24F 8/80
See application file for complete search history.

(56) References Cited

U.S. PATENT DOCUMENTS

2004/0107723 A1 6/2004 Lee et al.
2006/0086138 A1 4/2006 Park et al.
(Continued)

FOREIGN PATENT DOCUMENTS

CN 102048382 A 5/2011
CN 203771568 U 8/2014
(Continued)

OTHER PUBLICATIONS

CN106382786 and translation (Year: 2017).*
(Continued)

*Primary Examiner* — Steven S Anderson, II
(74) *Attorney, Agent, or Firm* — SCULLY, SCOTT, MURPHY & PRESSER, P.C.

(57) ABSTRACT

An air treatment apparatus and an air conditioner are provided. The air treatment apparatus has a housing and one or more air treatment devices. An airflow passage is formed in the housing. A mounting cavity is formed in the airflow passage. A side of the mounting cavity has a mounting opening. Multiple mounting portions are disposed in the mounting cavity. Two opposite sides of each of the mounting portions have a first sliding surface and a second sliding surface, respectively. At least one of the air treatment devices is drawably mounted on the mounting portions through the mounting opening and in slidable fit with the first sliding surface and the second sliding surface. Each of the air treatment device is mountable on one of the mounting portions.

20 Claims, 7 Drawing Sheets

(51) Int. Cl.
*F24F 13/20* (2006.01)
*F24F 1/0087* (2019.01)

(56) References Cited

U.S. PATENT DOCUMENTS

| | | | |
|---|---|---|---|
| 2018/0017282 | A1 | 1/2018 | Liu et al. |
| 2021/0025601 | A1 | 1/2021 | Mun et al. |

FOREIGN PATENT DOCUMENTS

| | | | | | |
|---|---|---|---|---|---|
| CN | 106382786 | A | * | 2/2017 | ..... F25D 25/025 |
| CN | 106766509 | A | | 5/2017 | |
| CN | 106801900 | A | | 6/2017 | |
| CN | 107008067 | A | | 8/2017 | |
| CN | 107454934 | A | | 12/2017 | |
| CN | 207095163 | U | | 3/2018 | |
| CN | 207113389 | U | | 3/2018 | |
| CN | 207408259 | U | | 5/2018 | |
| CN | 108096936 | A | | 6/2018 | |
| CN | 210601914 | U | * | 5/2020 | |
| CN | 211476119 | U | | 9/2020 | |
| CN | 212319916 | U | | 1/2021 | |
| CN | 212390493 | U | | 1/2021 | |
| CN | 214501666 | U | | 10/2021 | |
| KR | 20080055015 | A | | 6/2008 | |
| KR | 20090092044 | A | | 8/2009 | |
| KR | 20180057394 | A | | 5/2018 | |
| WO | 2019033697 | A1 | | 2/2019 | |
| WO | 2020062996 | A1 | | 4/2020 | |

OTHER PUBLICATIONS

CN210601914 and translation (Year: 2020).*
International Search Report dated Oct. 26, 2021 issued in PCT/CN2021/091662.
Extended European search report dated May 16, 2024 received in European Patent Application No. 21924019.9.
First Office Action dated Nov. 4, 2024 for Chinese Patent Application No. 202110172461.7.

* cited by examiner

AIR TREATMENT APPARATUS AND AIR CONDITIONER

CROSS-REFERENCE TO RELATED APPLICATIONS

The present application is a continuation application of International Application No. PCT/CN2021/091662 filed on Apr. 30, 2021, which claims priority to Chinese Patent Application No. 202110172461.7 and No. 202120373153.6, both filed on Feb. 8, 2021, the entire contents of each of which are incorporated herein by reference. No new matter has been introduced.

FIELD

The present disclosure relates to the field of air treatment equipment technologies, and more particularly, to an air treatment apparatus and an air conditioner.

BACKGROUND

In the field of air treatment technologies, air treatment devices are regularly replaced or treated. In some technologies, air treatment devices are drawably set by guide rail assemblies. However, unreasonable settings of the guide rail assemblies make the air treatment devices prone to be inserted crookedly or inserted in a wrong position, resulting in less efficient mounting of the air treatment devices.

SUMMARY

Embodiments of the present disclosure provide an air treatment apparatus, contributing to improve a mounting efficiency of an air treatment device.

The present disclosure further provides an air conditioner with the above mentioned air treatment apparatus.

According to a first aspect of the present disclosure, an air treatment apparatus includes: a housing, an airflow passage being formed in the housing, a mounting cavity being formed in the airflow passage, a side of the mounting cavity having a mounting opening, a plurality of mounting portions being disposed in the mounting cavity, and two opposite sides of each of the plurality of mounting portions having a first sliding surface and a second sliding surface respectively; and at least one air treatment device drawably mounted on the plurality of mounting portions through the mounting opening and in slidable fit with the first sliding surface and the second sliding surface, each of the at least one air treatment device being able to be mounted on one of the plurality of mounting portions.

In some embodiments of the present disclosure, each of the plurality of mounting portions includes: a guide rail portion extending along a first direction, the guide rail portion having the first sliding surface and the second sliding surface; and a guide portion disposed at the mounting opening, the guide portion being connected to an end of the guide rail portion adjacent to the mounting opening, and the guide portion being configured to guide the at least one air treatment device to the guide rail portion.

In some embodiments of the present disclosure, the guide rail portion includes a first guide rail portion and a second guide rail portion, each of the first guide rail portion and the second guide rail portion having an elongated structure, the first guide rail portion and the second guide rail portion being arranged apart from each other along a second direction, the first sliding surface being located on a side of the first guide rail portion facing away from the second guide rail portion, the second sliding surface being located on a side of the second guide rail portion facing away from the first guide rail portion, and the second direction being perpendicular to the first direction.

In some embodiments of the present disclosure, the guide portion has an elongated structure extending along a curve, the guide portion being smoothly connected between the first guide rail portion and the second guide rail portion.

In some embodiments of the present disclosure, the guide portion has a connection surface, the connection surface including a first guide surface and a second guide surface, the first guide surface being connected to the first sliding surface, and the second guide surface being connected to the second sliding surface.

In some embodiments of the present disclosure, the plurality of mounting portions are protruding blocks disposed at the mounting cavity, each of the protruding blocks having a first side surface, a second side surface, and a third side surface connected sequentially, the first side surface being formed as the first sliding surface, the second side surface being formed as the connection surface, the third side surface being formed as the second sliding surface.

In some embodiments of the present disclosure, an end of the first sliding surface adjacent to the mounting opening and an end of the second sliding surface adjacent to the mounting opening are connected to each other to form an end of the mounting portion adjacent to the mounting opening into an enclosed end.

In some embodiments of the present disclosure, the plurality of mounting portions are U-shaped ribs disposed at the mounting cavity, an outer surface of each of the U-shaped ribs having a first outer surface, a second outer surface, and a third outer surface connected sequentially, the first outer surface being formed as the first sliding surface, the second outer surface being formed as the connection surface, and the third outer surface being formed as the second sliding surface.

In some embodiments of the present disclosure, along the first direction, the first guide surface and the second guide surface extend away from each other in directions towards a center of a corresponding mounting portion of the plurality of mounting portions. The first guide surface is a plane surface or a curved surface and the second guide surface is a plane surface or a curved surface, both the first guide surface and the second guide surface being obliquely disposed relative to the first direction when both the first guide surface and the second guide surface are the plane surfaces.

In some embodiments of the present disclosure, a width of the guide portion in a second direction increases towards the center of a corresponding mounting portion of the plurality of mounting portions along the first direction, the second direction being perpendicular to the first direction.

In some embodiments of the present disclosure, multiple mounting portions of the plurality of mounting portions are disposed on each of two opposite sides of the mounting cavity, the mounting portions disposed on a same one of the two opposite sides of the mounting cavity being evenly arranged at intervals.

In some embodiments of the present disclosure, the mounting portions disposed on the same one of the two opposite sides of the mounting cavity are of same thickness.

In some embodiments of the present disclosure, the mounting portions disposed on different ones of the two opposite sides of the mounting cavity are of different thickness.

In some embodiments of the present disclosure, the at least one air treatment device includes a plurality of air treatment devices, each of the plurality of air treatment devices having a first retaining bar and a second retaining bar, the first retaining bar and the second retaining bar being arranged apart from each other, the first sliding surface being in slidable fit with the first retaining bar, and the second sliding surface being in slidable fit with the second retaining bar.

In some embodiments of the present disclosure, a guide slot is formed at the mounting opening between at least two adjacent mounting portions of the plurality of the mounting portions, the guide slot being configured to guide two adjacent air treatment devices to corresponding mounting portions of the plurality of the mounting portions.

According to a second aspect of the present disclosure, an air conditioner includes a housing and the air treatment apparatus based on the embodiment of the present disclosure, the air treatment apparatus being disposed within the housing.

Additional aspects and advantages of the present disclosure will be given at least in part in the following description, or become apparent at least in part from the following description, or can be learned from practicing of the present disclosure.

Figure 1:
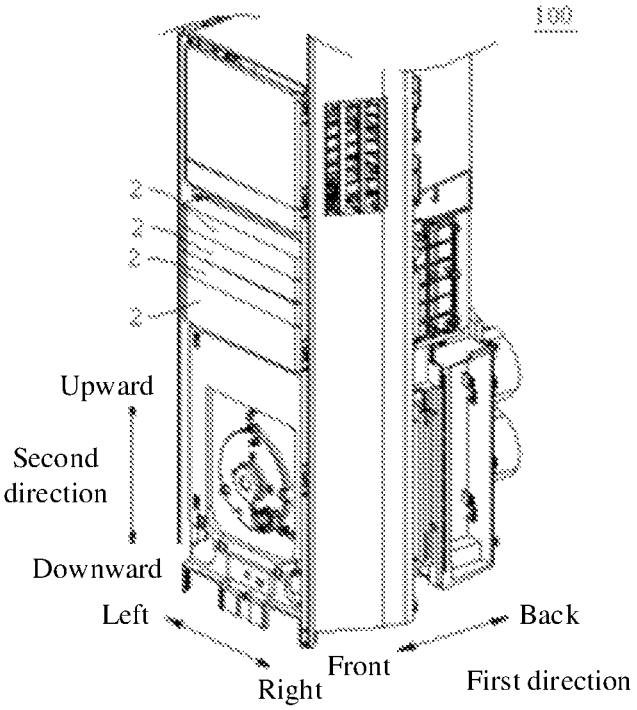
FIG. 1 is a schematic diagram of an air treatment apparatus according to an embodiment of the present disclosure.

The reference signs are explained as follows:

air conditioner 200;

housing 101;

front panel 1011; upper panel 1011*a*; lower panel 1011*b*; rear case 1012; top cover 1013; chassis 1014; air duct component 102; heat exchanger component 103; air outlet frame component 104;

air treatment apparatus 100;

housing 1; airflow passage 10; mounting cavity 10*a*; mounting opening 10*b;* mounting portion 11; first sliding surface 11*a*; second sliding surface 11*b;* guide rail portion 110; first guide rail portion 111; second guide rail portion 112;

guide portion 113; connection surface 1131; first guide surface 1131*a*; second guide surface 1131*b;* protruding block 11A; first side surface A1; second side surface A2; third side surface A3;

U-shaped rib 11B; first outer surface B1; second outer surface B2; third outer surface B3;

guide bar 12; guide slot 12*a;* air treatment device 2; slide groove 20; first retaining bar 20*a*; second retaining bar 20*b*; first protrusion 20*c*; second protrusion 20*d*.

DETAILED DESCRIPTION OF THE EMBODIMENTS

The embodiments of the present disclosure will be described in detail below with reference to examples thereof as illustrated in the accompanying drawings, throughout which same or similar elements are denoted by same or similar reference numerals. The embodiments described below with reference to the drawings are illustrative only, and are intended to explain, rather than limiting, the present disclosure.

Various embodiments or examples for implementing different structures of the present disclosure are provided below. In order to simplify the description of the present disclosure, components and arrangements of specific examples are described herein. These specific examples are merely for the purpose of illustration, rather than limiting the present disclosure. Further, the same reference numerals and/or reference letters may appear in different examples of the present disclosure for the purpose of simplicity and clarity, instead of indicating a relationship between different embodiments and/or the discussed arrangements. In addition, the present disclosure provides examples of various specific processes and materials. However, applications of other processes and/or the use of other materials are conceivable for those of ordinary skill in the art.

In the following, an air treatment apparatus 100 according to an embodiment of the present disclosure is described with reference to the accompanying drawings.

Figure 2:
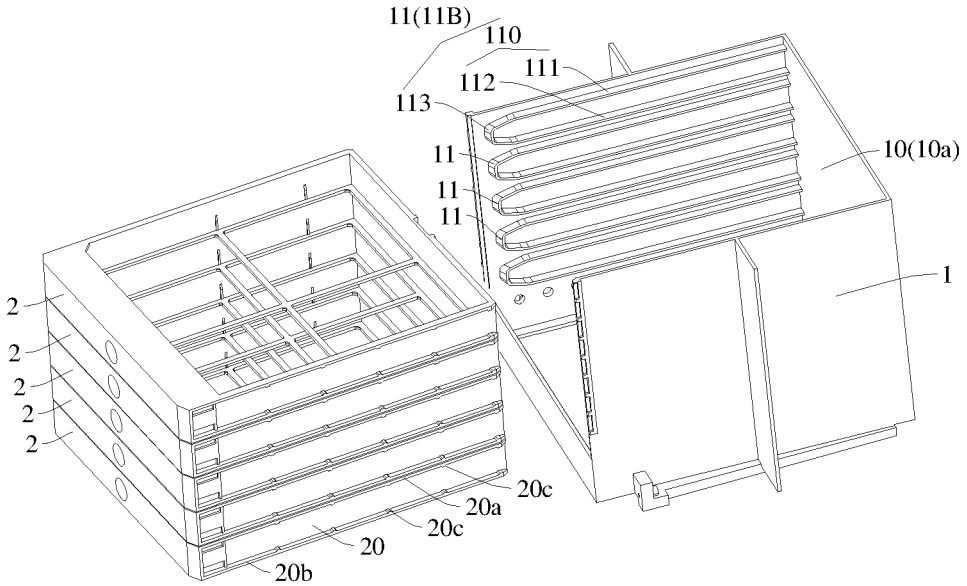
FIG. 2 is a schematic diagram of a housing and an air treatment device illustrated in FIG. 1.

As illustrated in FIG. 1 and FIG. 2, the air treatment apparatus 100 includes a housing 1 and an air treatment device 2. An airflow passage 10 is formed in the housing 1. The airflow passage 10 has an air inlet and an air outlet. A mounting cavity 10*a* is formed in the airflow passage 10, and a plurality of mounting portions 11 are provided in the mounting cavity 10*a*. The mounting portion 11 can be disposed on a wall of the mounting cavity 10*a*. The air treatment device 2 is drawably mounted on the mounting portion 11 through a mounting opening 10*b*, and the mounting portion 11 slidably fits with the air treatment device 2. It should be noted that in the description of the present disclosure, the meaning of "plurality" is two or more.

The air treatment device 2 can treat air flowing into the airflow passage 10. For example, the air treatment device 2 can include at least one of a humidification device, a filter device, a dust removal device, a formaldehyde removal device, a sterilization device, and an odor removal device, to achieve filtration, humidification, sterilization, and purification of the air flowing through the air treatment apparatus 100.

In the illustration of FIG. 1 and FIG. 2, for example, one side of the mounting cavity 10*a* (e.g. a front side in FIG. 1) is formed with the mounting opening 10*b*. The mounting opening 10*b* may extend through the housing 1 in a thickness direction of the housing 1. The air treatment device 2 is drawably mounted on the plurality of mounting portions 11 through the mounting opening 10*b*, enabling quick mounting and dismounting of the air treatment device 2.

Figure 3:
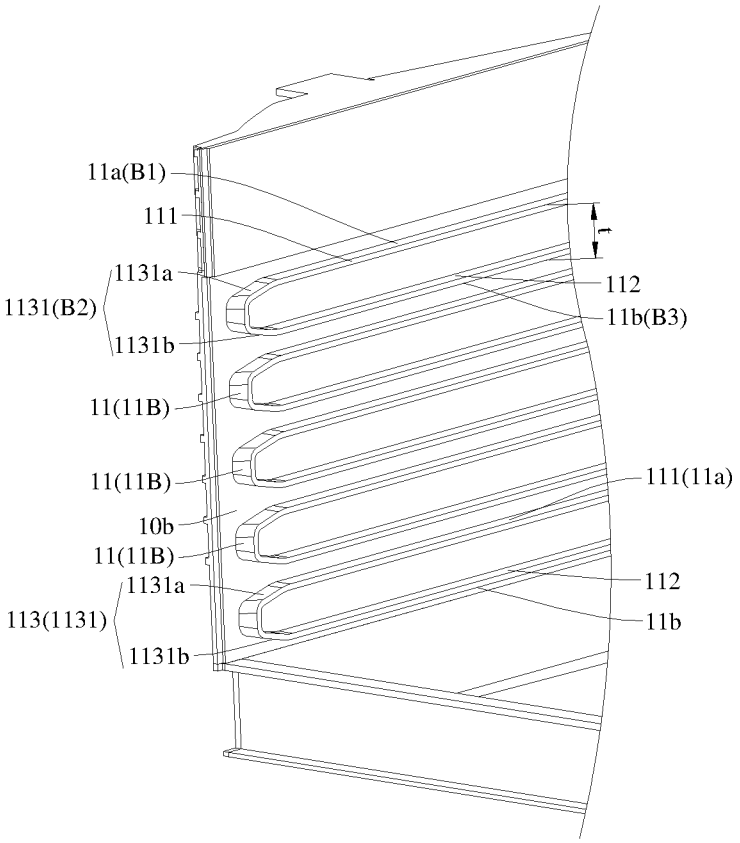
FIG. 3 is a partial schematic diagram of the housing illustrated in FIG. 2.
Figure 4:
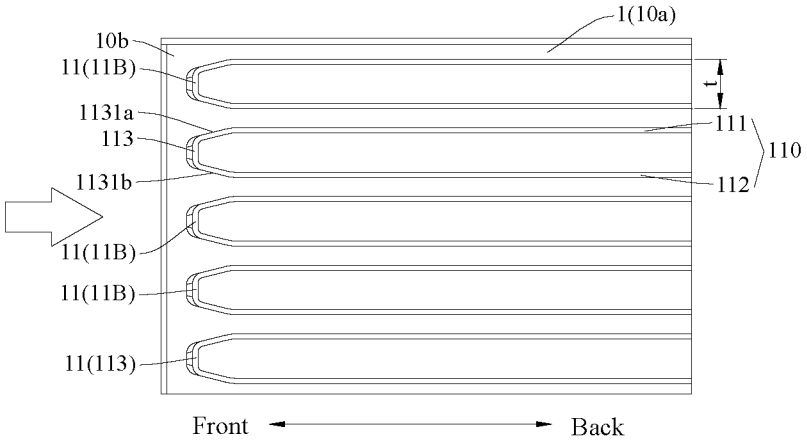
FIG. 4 is another schematic diagram of the housing illustrated in FIG. 2, where an arrow direction indicates a mounting direction of the air treatment device.

As illustrated in FIG. 2 to FIG. 4, the mounting portion 11 has a first sliding surface 11*a* and a second sliding surface

11*b* on two opposite sides of the mounting portion 11 respectively. One of the opposite sides of the mounting portion 11 has the first sliding surface 11*a*, and the other side of the opposite sides of the mounting portion 11 has the second sliding surface 11*b*. The first sliding surface 11*a* and the second sliding surface 11*b* slidably fit with the air treatment device 2. In the illustration of FIG. 2 to FIG. 4, for example, the air treatment device 2 may have a slide groove 20. The first sliding surface 11*a* may slidably fit with a sidewall on one of two opposite sides of the slide groove 20, and the second sliding surface 11*b* may slidably fit with a sidewall on the other side of the two opposite sides of the slide groove 20.

Since the first sliding surface 11*a* and the second sliding surface 11*b* are in slidable fit with the air treatment device 2, it is convenient to realize an effective restriction of the air treatment device 2 through the mounting portion 11, and effectively ensure that a drawing direction of the air treatment device 2 is always parallel to an extending direction of the mounting portion 11. It can avoid a crooked insertion of the air treatment device 2 during a mounting process, and also avoid a crooked drawing of the air treatment device 2 during a process of drawing out the mounting cavity 10*a*, which is conducive to improving the drawing efficiency of the air treatment device 2.

The air treatment device 2 is one or more, and each air treatment device 2 can be mounted on any of the mounting portions 11. For example, when the air treatment device 2 is one, the air treatment device 2 can be drawably mounted on any one of the plurality of mounting portions 11, and when the air treatment device 2 is more than one, each air treatment device 2 can be drawably mounted on any one of the plurality of mounting portions 11. This makes the mounting portions 11 have good versatility, which facilitates flexible assembly between the air treatment device 2 and the housing 1 and improves the assembly efficiency of the air treatment device 2 and the housing 1. Moreover, when the plurality of the air treatment devices 2 is provided, relative positions of the plurality of air treatment devices 2 can be reasonably adjusted based on actual needs to reasonably utilize the plurality of air treatment devices 2.

It can be understood that when the plurality of the air treatment devices 2 is provided, the plurality of air treatment devices 2 can have the same or different purification effect on the airflow. For example, the plurality of air treatment devices 2 can all be filter devices, or the plurality of air treatment devices 2 can include filter devices, humidification devices, sterilization devices, etc., enriching functions of the air treatment apparatus 100.

According to the air treatment apparatus 100 of one embodiment of the present disclosure, setting the first sliding surface 11*a* and the second sliding surface 11*b* of the plurality of mounting portions 11 to be in slidable fit with the air treatment device 2 is convenient to ensure that a drawing direction of the air treatment device 2 is always parallel to an extending direction of the plurality of mounting portions 11, which facilitates improving the mounting efficiency of the air treatment device 2.

It can be understood that the air inlet of the airflow passage 10 may include a fresh air inlet and/or an indoor air inlet. In an example of fresh air, fresh air may mean air flowing into the air treatment apparatus 100 from outdoors, and the fresh air is suitable to flow into the airflow passage 10 from the fresh air inlet and flow through the air treatment device 2 for purification within the airflow passage 10 with a final outflow through the air outlet of the airflow passage.

In some embodiments of the present disclosure, as illustrated in FIG. 1 to FIG. 4, each of the plurality of mounting portions 11 includes a guide rail portion 110 and a guide portion 113. The guide rail portion 110 extends along a first direction (e.g. a front-back direction in FIG. 1) that makes the air treatment device 2 suitable for a drawable fit with the mounting cavity 10*a* in the first direction. The guide rail portion 110 has the first sliding surface 11*a* and the second sliding surface 11*b*. The guide portion 113 is disposed at the mounting opening 10*b*, and the guide portion 113 is connected to an end of the guide rail portion 110 adjacent to the mounting opening 10*b*. In a mounting direction of the air treatment device 2, the guide portion 113 is located at an upstream end of the guide rail portion 110. The guide portion 113 can be configured to successfully guide the at least one air treatment device 2 to fit with the guide rail portion 110, avoiding the crooked insertion of the air treatment device 2, which is conducive to further improving the mounting efficiency of the air treatment device 2.

In some embodiments of the present disclosure, as illustrated in FIG. 1 to FIG. 4, the guide rail portion 110 includes a first guide rail portion 111 and a second guide rail portion 112. Each of the first guide rail portion 111 and the second guide rail portion 112 has an elongated structure. The first guide rail portion 111 and the second guide rail portion 112 are arranged apart from each other along a second direction (e.g. an up-and-down direction in FIG. 1). The first sliding surface 11*a* is formed on a side of the first guide rail portion 111 facing away from the second guide rail portion 112, and the second sliding surface 11*b* is formed on a side of the second guide rail portion 112 facing away from the first guide rail portion 111, i.e., in the second direction, the first sliding surface 11*a* is located on a side of the first guide rail portion 111 away from the second guide rail portion 112, and the second sliding surface is located on a side of the second guide rail portion away from the first guide rail portion 111. It is clear that the first sliding surface 11*a* and the second sliding surface 11*b* are surfaces on two different guide rail portions respectively. A sum of a thickness of the first guide rail portion 111 in the second direction and a thickness of the second guide rail portion 112 in the second direction is less than a distance between the first sliding surface 11*a* and the second sliding surface 11*b* in the second direction.

It can be understood that when the guide rail portion 110 includes the first guide rail portion 111 and the second guide rail portion 112, the guide portion 113 is connected between the first guide rail portion 111 and the second guide rail portion 112, and then one end of the first guide rail portion 111 adjacent to the mounting opening 10*b* and one end of the second guide rail portion 112 adjacent to the mounting opening 10*b* can be connected by the guide portion 113, facilitating quick insertion of the air treatment device 2 into a correct position.

Therefore, by arranging the first guide rail portion 111 and the second guide rail portion 112 apart from each other in the second direction, and making the first sliding surface 11*a* and the second sliding surface 11*b* formed on the first guide rail portion 111 and the second guide rail portion 112 respectively, the amount of material consumed for the entire guide rail portion 110 can be reduced thereby reducing costs.

It should be noted that in the description of the present disclosure, "elongated structure" can be understood to mean that the structure has a large extension length in relation to the cross-sectional dimensions of the structure.

In some embodiments of the present disclosure, as illustrated in FIG. 2 to FIG. 4, the guide portion 113 has an elongated structure extending along a curve, and the guide portion 113 is smoothly connected between the first guide rail portion 111 and the second guide rail portion 112. The two ends of the guide portion 113 can be connected to the first guide rail portion 111 and the second guide rail portion 112 respectively, which makes the whole mounting portion 11 form an elongated structure, and the mounting portion 11 can be extended into a U-shaped structure, effectively reducing the amount of material consumed by the mounting portion 11 and reducing costs.

In the illustration of FIG. 2 to FIG. 4, for example, a thickness of the guide portion 113 may be substantially equal to the thickness of the first guide rail portion 111 and the thickness of the second guide rail portion 112, which makes the entire mounting portion 11 substantially equivalent in thickness at any given position. A length of the guide portion 113 may be less than a length of the first guide rail portion 111 and a length of the second guide rail portion 112, facilitating a formation of the mounting portion 11, which may be substantially formed into the U-shaped structure.

The present disclosure is not limited to any of these examples. The guide portion 113 may further be formed as a block structure, such as a solid block structure, in which case the guide portion 113 may also achieve a connection between the end of the first guide rail portion 111 adjacent to the mounting opening 10*b* and the end of the second guide rail portion 112 adjacent to the mounting opening 10*b*.

Figure 6:
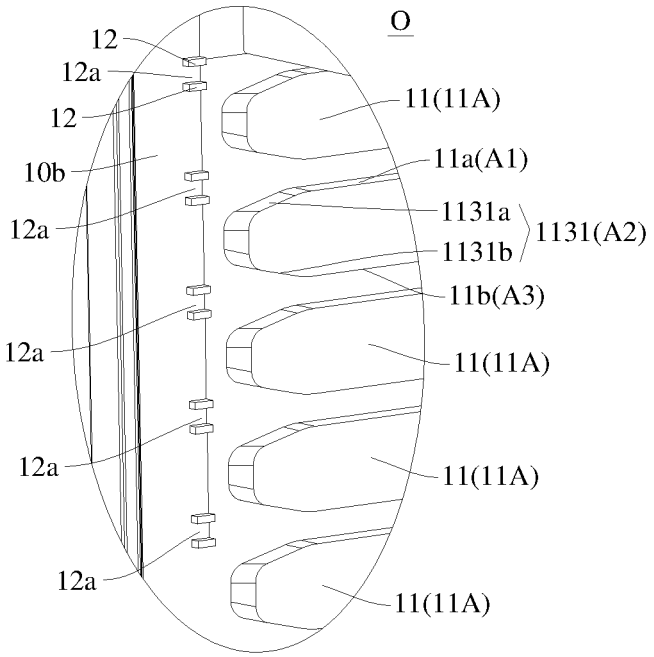
FIG. 6 is an enlarged diagram of the part O illustrated in a circle in FIG. 5.

In some embodiments of the present disclosure, as illustrated in FIG. 3 and FIG. 6, the first sliding surface 11*a* and the second sliding surface 11*b* are connected by the guide portion 113. For example, the guide portion 113 has a connection surface 1131, and the connection surface 1131 includes a first guide surface 1131*a* and a second guide surface 1131*b*. The first guide surface 1131*a* is connected to the first sliding surface 11*a*, so that the first guide surface 1131*a* can be configured to guide the air treatment device 2 to fit with the first sliding surface 11*a*. The second guide surface 1131*b* is connected to the second sliding surface 11*b*, so that the second guide surface 1131*b* can be configured to guide the air treatment device 2 to fit with the second sliding surface 11*b*, further avoiding crooked insertion of the air treatment device 2 during the mounting process and ensuring efficient mounting.

Figure 5:
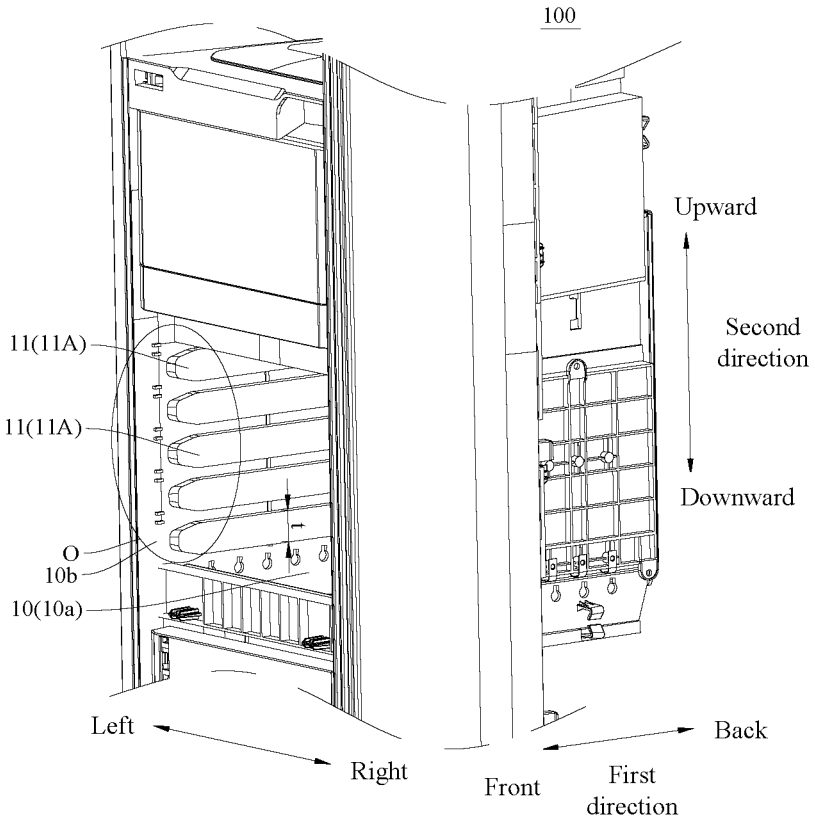
FIG. 5 is a partial schematic diagram of an air treatment apparatus according to another embodiment of the present disclosure.

In some embodiments of the present disclosure, as illustrated in FIG. 5 and FIG. 6, the plurality of mounting portions 11 are protruding blocks 11A disposed at the mounting cavity 10*a*, and each of the protruding blocks 11A has a first side surface A1, a second side surface A2, and a third side surface A3 connected sequentially. The second side surface A2 is connected between the first side surface A1 and the third side surface A3. The first side surface A1 is formed as the first sliding surface 11*a*. The second side surface A2 is formed as the connection surface 1131. The third side surface A3 is formed as the second sliding surface 11*b*. For example, in the illustration of FIG. 5 and FIG. 6, the protruding blocks 11A can extend in the front-back direction. An upper side of the protruding blocks 11A is the first side surface A1 and the upper side of the protruding blocks 11A is formed as the first sliding surface 11*a*. A front side of the protruding blocks 11A is the second side surface A2 and the front side of the protruding blocks 11A can be formed as the connection surface 1131. A lower side of the protruding blocks 11A is the third side surface A3 and the lower side of the protruding blocks 11A can be formed as the second sliding surface 11*b*. The mounting portion 11 is structurally reliable and has a good load capacity.

The protruding blocks 11A may be of solid protruding block structures.

In some embodiments of the present disclosure, as illustrated in FIG. 2 and FIG. 3, an end of the first sliding surface 11*a* adjacent to the mounting opening 10*b* and an end of the second sliding surface 11*b* adjacent to the mounting opening 10*b* are connected to each other to form an end of the mounting portion 11 adjacent to the mounting opening 10*b* into an enclosed end, i.e. the end of the mounting portion 11 adjacent to the mounting opening 10*b* is not formed with any opening. When mounting the air treatment device 2, the air treatment device 2 can be aligned with the enclosed end of the mounting portion 11 and then pushed, thereby making the air treatment device 2 fit quickly into the mounting portion 11 to avoid a low mounting efficiency caused by inserting the air treatment device 2 into a wrong position, further improving the mounting efficiency of the air treatment device 2.

In some embodiments of the present disclosure, as illustrated in FIG. 2 and FIG. 3, the plurality of mounting portions 11 are U-shaped ribs 11B disposed at the mounting cavity 10*a*. An outer surface of each of the U-shaped ribs 11B has a first outer surface B1, a second outer surface B2, and a third outer surface B3 connected sequentially. A second outer surface B2 is connected between a first outer surface B1 and a third outer surface B3. The first outer surface B1 is formed as the first sliding surface 11*a*. The second outer surface B2 is formed as the connection surface 1131. The third outer surface B3 is formed as the second sliding surface 11*b*. For example, in the illustration of FIG. 2 and FIG. 3, the U-shaped rib 11B extends in the front-back direction and an opening of the U-shaped rib 11B is arranged backward. An upper surface of the U-shaped rib 11B is formed as the first sliding surface 11*a*. A front surface of the U-shaped rib 11B is formed as the connection surface 1131. The upper surface of the U-shaped rib 11B is formed as the first sliding surface 11*a*. The front side surface of the U-shaped rib 11B is formed as the connection surface 1131, and the lower surface of the U-shaped rib 11B is formed as the second sliding surface 11*b*. In this way, it is possible to reduce the amount of material consumed by the mounting portion 11 and to reduce material costs, while maintaining the structural reliability of the mounting portion 11.

In some embodiments of the present disclosure, as illustrated in FIG. 3, FIG. 4 and FIG. 6, along the first direction, the first guide surface 1131*a* and the second guide surface 1131*b* extend away from each other in directions towards a center of a corresponding mounting portion of the plurality of mounting portions 11. As such, along the first direction, a width of the guide portion 113 in the second direction increases towards the center of a corresponding mounting portion of the plurality of mounting portions 11, ensuring that the guide portion 113 effectively guides the air treatment device 2 to the first guide rail portion 111 and the second guide rail portion 112. For example, in the illustration of FIG. 4, with the first direction as the front-back direction, the first guide surface 1131*a* and the second guide surface 1131*b* are extended front-to-back towards directions away from each other.

The first guide surface 1131*a* is a plane surface or a curved surface and the second guide surface 1131*b* is a plane surface or a curved surface. The following cases are included: 1. the first guide surface 1131*a* is a plane surface and the second guide surface 1131*b* is a plane surface; 2. the first guide surface 1131*a* is a plane surface and the second guide surface 1131*b* is a curved surface; 3. the first guide surface 1131*a* is a curved surface and the second guide surface 1131*b* is a plane surface; 4. the first guide surface 1131*a* is a curved surface and the second guide surface

1131*b* is a curved surface. The first guide surface 1131*a* and the second guide surface 1131*b* are flexibly arranged, which is conducive to a diversified structural design of the housing 1 and making the housing 1 better meet the actual differentiated needs.

For example, in the illustration of FIG. 4 and FIG. 6, both the first guide surface 1131*a* and the second guide surface 11311*b* are the plane surfaces, and the first guide surface 1131*a* and the second guide surface 1131*b* may be obliquely disposed relative to the first direction. An end of the first guide surface 1131*a* away from the first sliding surface 11*a* and an end of the second guide surface 1131*b* away from the second sliding surface 11*b* may be connected in transition to avoid the guide portion 113 forming a sharp-edged structure. The first guide surface 1131*a* is connected in transition to the first sliding surface 11*a* and the second guide surface 1131*b* is connected in transition to the second sliding surface 11*b*. The present disclosure is not limited to any of these examples, for example, both the first guide surface 1131*a* and the second guide surface 1131*b* are curved surfaces, or one of the first guide surface 1131*a* and the second guide surface 1131*b* is a plane surface and the other is a curved surface.

When both the first guide surface 1131*a* and the second guide surface 1131*b* are the plane surfaces, one of the first guide surface 1131*a* and the second guide surface 1131*b* may also be arranged parallel to the first direction and the other of the first guide surface 1131*a* and the second guide surface 1131*b* may be obliquely disposed relative to the first direction, similarly making it possible for the guide portion 113 to quickly guide the air treatment device 2 to the guide rail portion 110.

In some embodiments of the present disclosure, as illustrated in FIG. 2 to FIG. 4 and FIG. 6, the width of the guide portion 113 in the second direction increases towards the center of the corresponding mounting portion of the plurality of mounting portions 11 along the first direction. This means that along the first direction, the width of the guide portion 113 in the second direction increases towards the center of the corresponding mounting portion of the plurality of mounting portions 11. The guide portion 113 thereby effectively serves to guide the air treatment device 2 and to quickly guide the air treatment device 2 to the guide rail portion 110.

For example, in the illustration of FIG. 2 to FIG. 4 and FIG. 6, the mounting opening 10*b* is formed on a front side of the housing 1. The air treatment device 2 is mounted in the mounting cavity 10*a* from front to back. The width of the guide portion 113 in the up-and-down direction gradually decreases from front to back, facilitating a quick guide of the air treatment device 2 to a position where it fits into the guide rail portion 110.

In some embodiments of the present disclosure, as illustrated in FIG. 2 and FIG. 6, the plurality of mounting portions 11 are disposed on each of two opposite sides of the mounting cavity 10*a*. Mounting portions 11 are disposed on one of the two opposite sides of the mounting cavity 10*a*, and mounting portions 11 are also disposed on the other side of the two opposite sides of the mounting cavity 10*a*. The mounting portions disposed on the same side of the mounting cavity 10*a* are evenly arranged at intervals, i.e. the distance between any two adjacent mounting portions 11 of the plurality of mounting portions 11 disposed on the same side of the mounting cavity 10*a* is substantially equal to the distance between any two remaining adjacent mounting portions 11. That means that the distance between any two adjacent mounting portions 11 of the plurality of mounting portions 11 disposed on the same side of the mounting cavity 10*a* is equal to the distance between any two remaining adjacent mounting portions 11, or the distance between any two adjacent mounting portions 11 of the plurality of mounting portions 11 disposed on the same side of the mounting cavity 10*a* and the distance between any two remaining adjacent mounting portions 11 are slightly different and their difference can be ignored. Therefore, it is convenient to further ensure that each air treatment device 2 can be mounted on any one of the mounting portions 11. At the same time, when the plurality of air treatment devices 2 are provided and each of the plurality of mounting portions 11 has an air treatment device 2, it is convenient to achieve a seal between two adjacent air treatment devices 2, which can avoid sealing difficulties caused by unequal distance between the plurality of air treatment devices 2, etc.

As illustrated in FIG. 2 and FIG. 6, the plurality of mounting portions 11 disposed on the same side of the mounting cavity 10*a* can be arranged at intervals in a direction perpendicular to the extension direction of the mounting portions 11. When each mounting portion 11 has an air treatment device 2, the plurality of air treatment devices 2 can be arranged in a cascade, so that the plurality of air treatment devices 2 can process the airflow sequentially, which is conducive to saving the occupation space of the air treatment devices 2. For example, in the illustration of FIG. 2, there are five mounting portions 11 disposed on the same side of the mounting cavity 10*a* and five air treatment devices 2. Each air treatment device 2 can be drawably fit into any of the five mounting portions 11 mentioned above. Of course, the number of air treatment devices 2 can be less than the number of mounting portions 11 disposed on the same side of the mounting cavity 10*a*.

Optionally, in the illustration of FIG. 2, the plurality of mounting portions 11 disposed on a left or right side of the mounting cavity 10*a* are arranged evenly at intervals in a vertical direction, and the interval between two adjacent mounting portions 11 may be less than the width of a mounting portion 11 in the vertical direction.

It can be understood that intervals of the plurality of mounting portions 11 located on one side of the mounting cavity 10*a* may be equal or unequal to intervals of the plurality of mounting portions 11 located on the other side of the mounting cavity 10*a*.

In some embodiments of the present disclosure, as illustrated in FIG. 2 to FIG. 5, the mounting portions 11 disposed on the same side of the two opposite sides of the mounting cavity 10*a* are of same thickness. The plurality of mounting portions 11 disposed on one of sides of the mounting cavity 10*a* has same thickness and the plurality of mounting portions 11 disposed on the other side of the mounting cavity 10*a* has same thickness, thereby facilitating further versatility of the mounting portions 11. In this case, the thickness of the mounting portion 11 is t (as illustrated in FIG. 3 to FIG. 5), and the thickness of the mounting portion 11 can be understood as a distance between the first sliding surface 11*a* and the second sliding surface 11*b* in the mounting portion 11.

It can be understood that the thicknesses of the mounting portions 11 disposed on opposite sides of the mounting cavity 10*a* may be equal or unequal, and to be more specific, the thickness t1 of the mounting portion 11 disposed on one side of the mounting cavity 10*a* and the thickness t2 of the mounting portion 11 disposed on the other side of the mounting cavity 10*a* may be equal or unequal.

In some embodiments of the present disclosure, the mounting portions 11 disposed on different sides of the two opposite sides of the mounting cavity 10*a* are of different thickness. For two mounting portions 11, if the two mounting portions 11 are disposed on opposite sides of the mounting cavity 10*a*, the thickness of the two mounting portions 11 is unequal. For example, if the mounting portions 11 are disposed on the left and right sides of the mounting cavity 10*a*, the thickness of the mounting portion 11 disposed on the left side of the mounting cavity 10*a* is unequal to the thickness of the mounting portion 11 disposed on the right side of the mounting cavity 10*a*. This allows for a dummy-proof design of the mounting portion 11 and facilitates operators to quickly mount the air treatment device 2 on the mounting portion 11 in a correct placement direction.

For example, when the thicknesses of the mounting portions 11 disposed on opposite sides of the mounting cavity 10*a* are unequal, accordingly, widths of the slide grooves 20 on the opposite sides of the air treatment device 2 may be unequal when the air treatment device 2 has the slide grooves 20 for slidably fitting with the mounting portions 11. For example, the mounting cavity 10*a* is provided with mounting portions 11 of different thicknesses on the left and right sides. The air treatment device 2 can have slide groove 20 on each of the left and right side for slidably fitting with the corresponding mounting portion 11, where the width of the slide groove 20 on the left and right side of the air treatment device 2 is different. In this way, it facilitates the dummy-proof design, making it possible for operators to quickly identify and locate a correct mounting direction for the air treatment device 2 to quickly mount the air treatment device 2 on the corresponding mounting portion 11, which facilitates avoiding a reverse mounting of the air treatment device 2.

Figure 7:
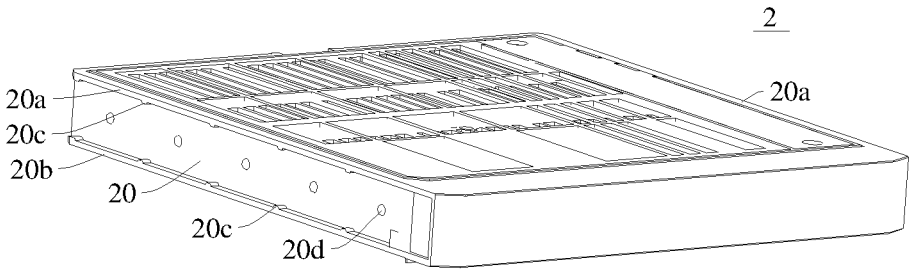
FIG. 7 is a schematic diagram of an air treatment device according to another embodiment of the present disclosure.

In some embodiments of the present disclosure, as illustrated in FIG. 2 and FIG. 7, the at least one air treatment device 2 includes a plurality of air treatment devices 2, and each of the plurality of air treatment devices 2 has a first retaining bar 20*a* and a second retaining bar 20*b*. The first retaining bar 20*a* and the second retaining bar 20*b* are arranged apart from each other and the slide groove 20 may be defined between the first retaining bar 20*a* and the second retaining bar 20*b*. The first sliding surface 11*a* may be in slidable fit with the first retaining bar 20*a*, and the second sliding surface 11*b* may be in slidable fit with the second retaining bar 20*b*. This facilitates an effective restriction of the air treatment device 2 by the mounting portion 11 and enables flexible placement of the air treatment apparatus 100. For example, the first retaining bar 20*a* and the second retaining bar 20*b* may be disposed at opposite ends of the air treatment device 2, and sidewalls of the first retaining bar 20*a* and the second retaining bar 20*b* opposite each other may be walls of the slide groove 20. When the mounting portion 11 fits into the slide groove 20, the mounting portion 11 is disposed between the first retaining bar 20*a* and the second retaining bar 20*b*.

As illustrated in FIG. 6, at least two adjacent mounting portions 11 are provided with a guide slot 12*a* between the mounting portions. For example, when the mounting portions 11 are two, the guide slot 12*a* is provided between the two mounting portions 11, and when the mounting portions 11 are three or more, the guide slot 12*a* is provided between at least two of the adjacent mounting portions 11. Then every two adjacent mounting portions 11 is provided with a guide slot 12*a*, or a part of multiple pairs of adjacent mounting portions 11 is provided with a guide slot 12*a* and a part of the multiple pairs of adjacent mounting portions 11 is not provided with a guide slot 12*a*. The guide slot 12*a* is disposed at the mounting opening 10*b*, and the guide slot 12*a* is disposed to guide each of the two adjacent air treatment devices 2 to the corresponding mounting portion 11, which facilitates further improvement of the mounting efficiency of the air treatment device 2.

It can be understood that the plurality of mounting portions 11 can also be provided with guide slot 12*a* on two sides in an arrangement direction, and the guide slot 12*a* is configured to guide an air treatment device 2 to the corresponding mounting portion 11. For example, in the illustration of FIG. 6, the plurality of mounting portions 11 are disposed at intervals in the up-and-down direction, and an upper side of the plurality of mounting portions 11 is also provided with the guide slot 12*a*, in which case the guide slot 12*a* may only be configured to guide the air treatment device 2 corresponding to the most upper mounting portion 11 to the mounting portion 11.

Optionally, in the illustration of FIG. 6, the housing 1 is provided with a plurality of sets of guide bars at intervals, and each set of guide bars includes two guide bars 12. The two guide bars 12 of the guide bar set are provided at intervals to define the guide slot 12*a*.

In other embodiments of the present disclosure, the mounting opening 10*b* can also be provided without the guide slot 12*a*, as illustrated in FIG. 2.

In some embodiments of the present disclosure, as illustrated in FIG. 2 and FIG. 7, the first retaining bar 20*a* is provided with a first protrusion 20*c* on a side facing the second guiding bar 20*b*, and/or, the second retaining bar 20*b* is provided with the first protrusion 20*c* on a side facing the first retaining bar 20*a*. It should be noted that in the description of the present disclosure, "and/or" has the meaning of including three parallel solutions, taking "A and/or B" as an example, including solution A, or solution B, or solutions in which both A and B are satisfied.

Therefore the arrangement of the first protrusion 20*c* includes the following solutions: 1. The side of the first retaining bar 20*a* facing the second guiding bar 20*b* is provided with the first protrusion 20*c*, and the second retaining bar 20*b* is not provided with the first protrusion 20*c;* 2. The side of the second retaining bar 20*b* facing the first retaining bar 20*a* is provided with a first protrusion 20*c*, and the first retaining bar 20*a* is not provided with a first protrusion 20*c;* 3. the first retaining bar 20*a* and the second retaining bar 20*b* are each provided with the first protrusion 20*c* on a side opposite to each other, i.e. the side of the first retaining bar 20*a* facing the second guiding bar 20*b* is provided with a first protrusion 20*c*, and the side of the second retaining bar 20*b* facing the first retaining bar 20*a* is provided with a first protrusion 20*c*. Thereby, by providing the first protrusion 20*c*, the walls of the slide groove 20 can contact the first sliding surface 11*a* and the second sliding surface 11*b* respectively through the first protrusion 20*c*, which can reduce a contact area between the slide groove 20 and the mounting portion 11, and reduce a sliding friction when the air treatment device 2 slides relative to the housing 1, facilitating a smooth extraction of the air treatment device 2.

For example, in the illustration of FIG. 2 and FIG. 7, the side of the first retaining bar 20*a* facing the second guiding bar 20*b* is provided with the first protrusion 20*c*, which is disposed protruding on a surface of the first retaining bar 20*a*. The first protrusion 20*c* on the first retaining bar 20*a* contacts the first sliding surface 11*a*. The side of the second retaining bar 20*b* facing the first retaining bar 20*a* is also provided with the first protrusion 20*c*, which is disposed protruding on a surface of the second retaining bar 20*b*. The first protrusion 20*c* on the second retaining bar 20*b* contacts the second sliding surface 11*b*. Therefore, when the air treatment device 2 slides relative to the housing 1, the first protrusion 20*c* on the first retaining bar 20*a* is in slidable fit with the first sliding surface 11*a*, and the first protrusion 20*c* on the second retaining bar 20*b* is in slidable fit with the second sliding surface 11*b*, thereby reducing the contact area between the first retaining bar 20*a* and the first sliding surface 11*a* and reducing the contact area between the second retaining bar 20*b* and the second sliding surface 11*b*. This effectively reduces a resistance to the sliding of the air treatment device 2 in relation to the housing 1, which facilitates the smooth extraction of the air treatment device 2 and improves extraction efficiency.

Optionally, in the illustration of FIG. 2 and FIG. 7, a plurality of first protrusions 20*c* on the first retaining bar 20*a* is provided, and the plurality of first protrusions 20*c* are disposed at intervals along an extension direction of the first retaining bar 20*a*. A plurality of first protrusions 20*c* on the second retaining bar 20*b* is provided, and the plurality of first protrusions 20*c* are disposed at intervals along an extension direction of the second retaining bar 20*b*.

It can be understood that when the first protrusion 20*c* is in contact with the mounting portion 11, the contact between the first protrusion 20*c* and the mounting portion 11 can be a surface contact, or a line contact, or a point contact. As can be seen, a cross-sectional shape of the first protrusion 20*c* can be specifically defined according to actual application.

In some embodiments of the present disclosure, as illustrated in FIG. 7, a second protrusion 20*d* is disposed on a wall surface of the slide groove 20 facing the mounting cavity 10*a*, and the second protrusion 20*d* protrudes out of the wall of the slide groove 20. The second protrusion 20*d* is located between the first retaining bar 20*a* and the second retaining bar 20*b*. The second protrusion 20*d* is suitable for contact with the mounting portion 11, so that by abutting against the mounting portion 11, it can have a certain restrictive effect on the air treatment device 2, which is convenient to prevent the air treatment device 2 from twisting during a drawing process, and is conducive to ensure that a drawing direction of the air treatment device 2 is always consistent. At the same time, under the same premise, it reduces a contact area between the second protrusion 20*d* and the guide rail portion 110, which ensures a smooth drawing of the air treatment device 2.

For example, when the mounting portion 11 is formed as an elongated solid structure, it is convenient to achieve contact between the mounting portion 11 and the second protrusion 20*d* for the restriction of the air treatment device 2. At this time, a plurality of the second protrusion 20*d* may be provided, and the plurality of the second protrusions 20*c* may be disposed at intervals along the drawing direction of the air treatment device 2, in order to ensure a smooth drawing process of the air treatment device 2 as a whole.

According to an embodiment of the present disclosure, an air conditioner 200 includes a housing 101 and an air treatment apparatus 100. The air treatment apparatus 100 is disposed within the housing 101. The air treatment apparatus 100 is the air treatment apparatus 100 according to the embodiment described above in the present disclosure.

The air conditioner 200 according to the embodiment of the present disclosure facilitates the improvement of the assembly efficiency of the air conditioner 200 by applying the air treatment apparatus 100 described above.

Figure 8:
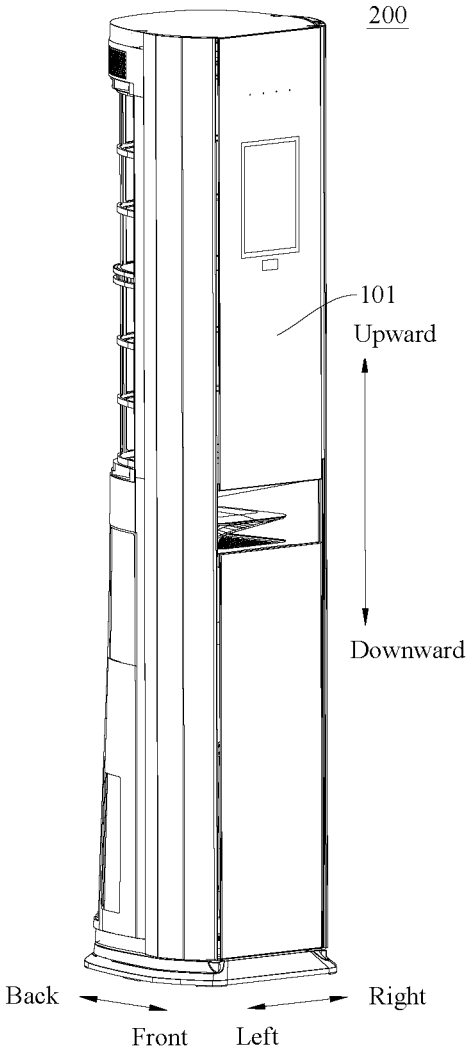
FIG. 8 is a schematic diagram of an air conditioner according to an embodiment of the present disclosure.
Figure 9:
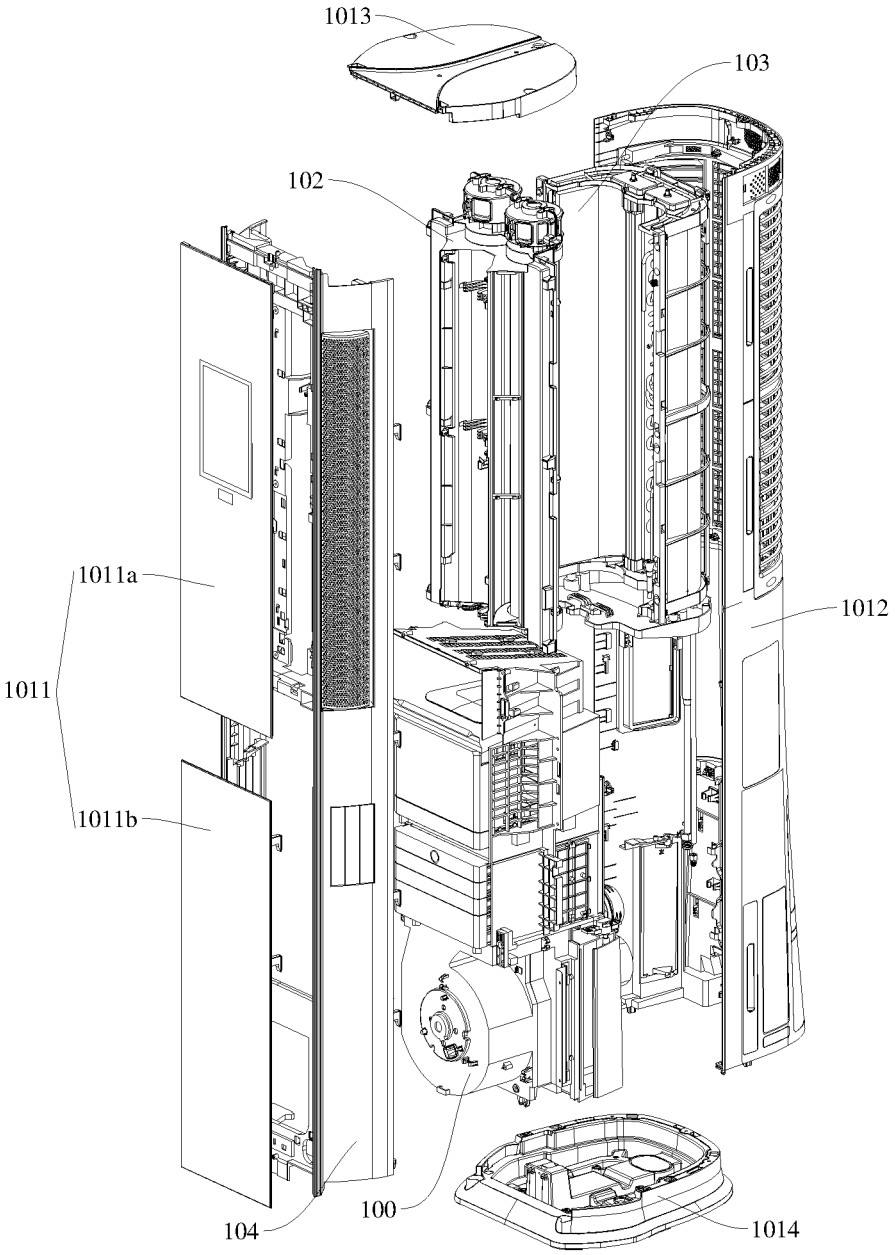
FIG. 9 is an exploded diagram of the air conditioner illustrated in FIG. 8.

For example, in the illustration of FIG. 8 and FIG. 9, the housing 101 includes a front panel 1011, a rear case 1012, a top cover 1013 and a chassis 1014. The top cover 1013 is disposed at an upper end of the front panel 1011 and the rear case 1012, and the chassis 1014 is disposed at a lower end of the front panel 1011 and the rear case 1012. The front panel 1011 includes an upper panel 1011*a* and a lower panel 1011*b*. The air conditioner 200 further includes an air duct component 102, a heat exchanger component 103 and an air outlet frame component 104. The air treatment apparatus 100 may be located in a lower middle portion of the housing 101 and the air treatment apparatus 100 is located on a lower side of the air duct component 102. In the up-and-down direction, the air treatment device 2 may be located in the middle portion of the air treatment apparatus 100. The left and right sides of the air treatment apparatus 100 may each be connected to the rear case 1012 by fasteners such as screws.

Of course, the disposing position of the air treatment apparatus 100 within the housing 101 is not limited to the above example.

It can be understood that the air conditioner can be a split type air conditioner, or an integral type air conditioner.

Other members and other operations of the air conditioner according to the embodiments of the present disclosure are known to those of ordinary skill in the art and will not be described in detail here.

The air treatment apparatus 100 according to the embodiments of the present disclosure is described in detail below in two specific embodiments with reference to FIG. 1 to FIG. 6. It should be understood that the embodiments described below are illustrative only, and are intended to explain, rather than limiting, the present disclosure.

In the embodiment as illustrated in FIG. 1 to FIG. 4, the air treatment apparatus 100 includes the housing 1 and the air treatment device 2. The mounting cavity 10*a* is formed within the housing 1, and the mounting opening 10*b* is formed on the front side of the mounting cavity 10*a*. The mounting opening 10*b* may extend through the housing 1 in a thickness direction of the housing 1. The air treatment device 2 is drawably mounted to the mounting cavity 10*a* in a front-back direction through the mounting opening 10*b*. In the illustration of FIG. 2, the plurality of the air treatment devices 2 is provided, and the air treatment devices 2 are filter devices. The air treatment devices 2 include a functional filter and a bracket. The functional filter is located on the bracket, and the bracket drawably fits with the mounting cavity 10*a*.

The mounting cavity 10*a* is provided with the plurality of mounting portions 11 on the left and right sides. The plurality of mounting portions 11 located on the same side of the mounting cavity 10*a* are disposed at intervals along the up-and-down direction, and each mounting portion 11 extends along the front-back direction. Each air treatment device 2 has a slide groove 20 formed on each of the left and right sides of the bracket of the air treatment device 2, and each slide groove 20 extends along the front-back direction. The mounting cavity 10*a* has a plurality of mounting positions, at each of which one air treatment device 2 may be mounted correspondingly, and each air treatment devices 2 may also be configured in any one of the mounting positions. Each mounting position corresponds to two mounting portions 11, and the two mounting portions 11 corresponding to each mounting position are located on the left and right sides of the mounting cavity 10*a*. Thus, in the example of FIG. 2 to FIG. 4, the mounting cavity 10*a* has five mounting portions 11 on the same side, so that five mounting positions are defined in the mounting cavity 10*a*.

As illustrated in FIG. 2 to FIG. 4, the mounting portion 11 includes the guide rail portion 110 and the guide portion 113.

The guide rail portion 110 includes the first guide rail portion 111 and the second guide rail portion 112, and both the first guide rail portion 111 and the second guide rail portion 112 extend into elongated structures in the front-back direction. The first guide rail portion 111 and the second guide rail portion 112 are disposed apart from each other in the up-and-down direction. The first sliding surface 11*a* is the upper surface of the first guide rail portion 111 and the second sliding surface 11*b* is the lower surface of the second guide rail portion 112. The guide portion 113 is located at the end of the guide rail portion 110 adjacent to the mounting opening 10*b*. The guide portion 113 can guide the slide groove 20 to fit into the guide rail portion 110 so that the upper wall surface of the slide groove 20 fits into the first sliding surface 11*a* and the lower wall surface of the slide groove 20 fits into the second sliding surface 11*b*.

The outer surface of the guide portion 113 has the connection surface 1131, which extends continuously as the curved surface. The connection surface 1131 includes the first guide surface 1131*a* and the second guide surface 1131*b*. The first guide surface 1131*a* can be transitionally connected to the first sliding surface 11*a*, and the second guide surface 1131*b* can be transitionally connected to the second sliding surface 11*b*. The end of the first guide surface 1131*a* away from the first sliding surface 11*a* can be connected in transition with the end of the second guide surface 1131*b* away from the second sliding surface 11*b*, so that the width of the guide portion 113 in the up-and-down direction gradually increases from front to back. Both the first guide surface 1131*a* and the second guide surface 1131*b* are formed as planes, and both the first guide surface 1131*a* and the second guide surface 1131*b* are disposed obliquely in relation to the front-back direction, i.e. an angle between the plane corresponding to the first guide surface 1131*a* and the front-to-back direction is acute, and an angle between the plane corresponding to the second guide surface 1131*b* and the front-to-back direction is acute.

As illustrated in FIG. 2 to FIG. 4, the guide portion 113 is formed as the elongated structure extending along the curve. The thickness of the guide portion 113 and the thickness of the first guide rail portion 111 and the thickness of the second guide rail portion 112 are substantially equivalent, which makes the entire mounting portion 11 form a substantially equal-thickness structure. At this time, the end of the mounting portion 11 adjacent to the mounting opening 10*b* is formed as the closed end, and the end of the mounting portion 11 away from the mounting opening 10*b* is formed as the open end. The mounting portion 11 may be formed as the U-shaped rib 11B. During the mounting of the air treatment device 2, the slide groove 20 moves from the closed end of the mounting portion 11 towards the open end of the mounting portion 11, making it possible for the slide groove 20 to fit quickly into the mounting portion 11.

As illustrated in FIG. 5 and FIG. 6, this embodiment has a substantially identical structure to that of the above embodiment. Same components are marked with same reference signs, and differences are: the mounting portion 11 being formed as an elongated solid block-like structure, the mounting portion 11 being formed as the protruding block 11A, the first sliding surface 11*a* being the upper surface of the protruding block 11A, the second sliding surface 11*b* being the lower surface of the protruding block 11A, and the connection surface 1131 being the front side of the protruding block 11A.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", etc., is based on the orientation or position relationship shown in the drawings, and is only for the convenience of describing the present disclosure and simplifying the description, rather than indicating or implying that the pointed apparatus or element must have a specific orientation, or be constructed and operated in a specific orientation, and therefore cannot be understood as a limitation of the present disclosure.

In the description of the present disclosure, it should be noted that terms such as "install", "connect", and "connect to" should be understood in a broad sense, unless otherwise clearly specified and limited. For example, it may be a fixed connection or a detachable connection or connection as one piece; mechanical connection or electrical connection; direct connection or indirect connection through an intermediate; or internal communication of two components. For those of ordinary skill in the art, the specific meaning of the above-mentioned terms in the present disclosure can be understood according to specific circumstances.

In the present disclosure, unless specified or limited otherwise, the first characteristic is "on" or "under" the second characteristic refers to the first characteristic and the second characteristic can be direct or via media indirect mountings, connections, and couplings. And, the first characteristic is "on", "above", "over" the second characteristic may refer to the first characteristic is right over the second characteristic or is diagonal above the second characteristic, or just refer to the horizontal height of the first characteristic is higher than the horizontal height of the second characteristic. The first characteristic is "below" or "under" the second characteristic may refer to the first characteristic is right over the second characteristic or is diagonal under the second characteristic, or just refer to the horizontal height of the first characteristic is lower than the horizontal height of the second characteristic.

In the description of the present disclosure, reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Without a contradiction, the different embodiments or examples and the features of the different embodiments or examples can be combined by those skilled in the art.

Although embodiments of the present disclosure have been illustrated and described, it is conceivable for those of ordinary skill in the art that various changes, modifications, replacements, and variations can be made to these embodiments without departing from the principles and spirit of the present disclosure. The scope of the present disclosure shall be defined by the claims as appended and their equivalents.

What is claimed is:

1. An air treatment apparatus comprising:

a housing, an airflow passage being formed in the housing, a mounting cavity being formed in the airflow passage, a side of the mounting cavity having a mounting opening, a plurality of mounting portions being disposed in the mounting cavity, and two opposite sides of each of the plurality of mounting portions having a first sliding surface and a second sliding surface respectively; and at least one air treatment device, wherein an air treatment device of the at least one air treatment device comprises a first retaining surface and a second retaining surface arranged apart from and facing the first retaining surface, a slide groove being defined between the first retaining surface and the second retaining surface, and wherein the air treatment device is configured to be drawably mounted to the housing by fitting a corresponding mounting portion of the plurality of mounting portions into the slide groove between the first retaining surface and the second retaining surface of the air treatment device so that the first sliding surface is in slidable fit with the first retaining surface and the second sliding surface is in slidable fit with the second retaining surface.

2. The air treatment apparatus according to claim 1, wherein each of the plurality of mounting portions comprises:

a guide rail portion extending along a first direction, the guide rail portion having the first sliding surface and the second sliding surface; and a guide portion disposed at the mounting opening, the guide portion being connected to an end of the guide rail portion adjacent to the mounting opening, and the guide portion being configured to guide the at least one air treatment device to the guide rail portion.

3. The air treatment apparatus according to claim 2, wherein the guide rail portion comprises a first guide rail portion and a second guide rail portion, each of the first guide rail portion and the second guide rail portion having an elongated structure, the first guide rail portion and the second guide rail portion being arranged apart from each other along a second direction, the first sliding surface being located on a side of the first guide rail portion facing away from the second guide rail portion, the second sliding surface being located on a side of the second guide rail portion facing away from the first guide rail portion, and the second direction being perpendicular to the first direction.

4. The air treatment apparatus according to claim 3, wherein the guide portion has an elongated structure extending along a curve, the guide portion being smoothly connected between the first guide rail portion and the second guide rail portion.

5. The air treatment apparatus according to claim 2, wherein the guide portion has a connection surface, the connection surface comprising a first guide surface and a second guide surface, the first guide surface being connected to the first sliding surface, and the second guide surface being connected to the second sliding surface.

6. The air treatment apparatus according to claim 5, wherein the plurality of mounting portions are protruding blocks disposed at the mounting cavity, each of the protruding blocks having a first side surface, a second side surface, and a third side surface connected sequentially, the first side surface being formed as the first sliding surface, the second side surface being formed as the connection surface, the third side surface being formed as the second sliding surface.

7. The air treatment apparatus according to claim 5, wherein an end of the first sliding surface adjacent to the mounting opening and an end of the second sliding surface adjacent to the mounting opening are connected to each other to form an end of a corresponding mounting portion adjacent to the mounting opening into an enclosed end.

8. The air treatment apparatus according to claim 7, wherein the plurality of mounting portions are U-shaped ribs disposed at the mounting cavity, an outer surface of each of the U-shaped ribs having a first outer surface, a second outer surface, and a third outer surface connected sequentially, the first outer surface being formed as the first sliding surface, the second outer surface being formed as the connection surface, and the third outer surface being formed as the second sliding surface.

9. The air treatment apparatus according to claim 5, wherein along the first direction, the first guide surface and the second guide surface extend away from each other in directions towards a center of a corresponding mounting portion of the plurality of mounting portions, wherein the first guide surface is a plane surface or a curved surface and the second guide surface is a plane surface or a curved surface, both the first guide surface and the second guide surface being obliquely disposed relative to the first direction when both the first guide surface and the second guide surface are plane surfaces.

10. The air treatment apparatus according to claim 2, wherein a width of the guide portion in a second direction increases towards a center of a corresponding mounting portion of the plurality of mounting portions along the first direction, the second direction being perpendicular to the first direction.

11. The air treatment apparatus according to claim 1, wherein multiple ones of the plurality of mounting portions are disposed on each of two opposite sides of the mounting cavity, mounting portions disposed on a same one of the two opposite sides of the mounting cavity being evenly arranged at intervals.

12. The air treatment apparatus according to claim 11, wherein the mounting portions disposed on the same one of the two opposite sides of the mounting cavity are of same thickness.

13. The air treatment apparatus according to claim 12, wherein the mounting portions disposed on different ones of the two opposite sides of the mounting cavity are of different thickness.

14. The air treatment apparatus according to claim 1, wherein the at least one air treatment device comprises a plurality of air treatment devices, each of the plurality of air treatment devices having a first retaining bar and a second retaining bar, the first retaining bar and the second retaining bar being arranged apart from each other, the first sliding surface being in slidable fit with the first retaining bar, and the second sliding surface being in slidable fit with the second retaining bar.

15. The air treatment apparatus according to claim 1, wherein a guide slot is formed at the mounting opening between at least two adjacent mounting portions of the plurality of mounting portions, the guide slot being configured to guide two adjacent air treatment devices to corresponding mounting portions of the plurality of mounting portions.

16. An air conditioner comprising:

another housing; and the air treatment apparatus according to claim 1, wherein the air treatment apparatus is disposed within said another housing.

17. The air conditioner according to claim 16, wherein each of the plurality of mounting portions comprises:

a guide rail portion extending along a first direction, the guide rail portion having the first sliding surface and the second sliding surface; and a guide portion disposed at the mounting opening, the guide portion being connected to an end of the guide rail portion adjacent to the mounting opening, and the guide portion being configured to guide the at least one air treatment device to the guide rail portion.

18. The air conditioner according to claim 17, wherein the guide rail portion comprises a first guide rail portion and a second guide rail portion, each of the first guide rail portion and the second guide rail portion having an elongated structure, the first guide rail portion and the second guide rail portion being arranged apart from each other along a second direction, the first sliding surface being located on a side of the first guide rail portion facing away from the second guide rail portion, the second sliding surface being located on a side of the second guide rail portion facing away from the first guide rail portion, and the second direction being perpendicular to the first direction.

19. The air conditioner according to claim 18, wherein the guide portion has an elongated structure extending along a curve, the guide portion being smoothly connected between the first guide rail portion and the second guide rail portion.

20. The air conditioner according to claim 17, wherein the guide portion has a connection surface, the connection surface comprising a first guide surface and a second guide surface, the first guide surface being connected to the first sliding surface, and the second guide surface being connected to the second sliding surface.

* * * * *